US005244203A

United States Patent [19]

Russel et al.

[11] Patent Number: 5,244,203

[45] Date of Patent: Sep. 14, 1993

[54] SHEET TRANSPORTING APPARATUS WITH A TRANSPORT BELT TO WHICH SHEETS ARE SELECTIVELY CLAMPED

[75] Inventors: Steven M. Russel, Pittsford; Robert H. Shea, Victor; Robert M. Peffer, Penfield, all of N.Y.

[73] Assignee: Eastman Kodak Company, Rochester, N.Y.

[21] Appl. No.: 873,264

[22] Filed: Apr. 24, 1992

[51] Int. Cl.[5] ..... B65H 5/02

[52] U.S. Cl. ..... 271/277; 271/204

[58] Field of Search ..... 271/204, 206, 277

[56] References Cited

U.S. PATENT DOCUMENTS

| | | | |
|---|---|---|---|
| 3,990,696 | 11/1976 | Landa | 271/94 |
| 4,083,556 | 4/1978 | Schilling et al. | 271/204 |
| 4,179,215 | 12/1979 | Hage | 355/50 |
| 4,284,348 | 8/1981 | Graswinckel | 355/75 |
| 4,506,978 | 3/1985 | Allocco, Jr. et al. | 355/14 SH |
| 4,779,717 | 10/1988 | Eberle | 271/204 X |
| 4,799,664 | 1/1989 | Burger | 271/204 X |
| 5,064,187 | 11/1991 | Muller | 271/204 |
| 5,169,139 | 12/1992 | Stauber et al. | 271/204 |

*Primary Examiner*—H. Grant Skaggs
*Assistant Examiner*—Carol Lynn Druzbick
*Attorney, Agent, or Firm*—Lawrence P. Kessler

[57] ABSTRACT

A sheet transporting apparatus for transporting document sheets, wherein passive gripper gates, of simplified construction, selectively attach a sheet to the transport belt of the sheet transporting apparatus. The sheet transporting apparatus comprises a transport belt having a passive mechanism for selectively clamping a document sheet thereto. The transport belt is moved along a path, and a sheet is delivered into association with the passive clamping mechanism. The passive clamping mechanism is selectively actuated to clamp a sheet delivered into association therewith to the transport belt for movement with the transport belt. A mechanism, located downstream in direction of movement of the transport belt, selectively deactuates the passive clamping mechanism to release a sheet from the clamping mechanism of the transport belt. Thereafter, the sheet is separated from the transport belt.

23 Claims, 4 Drawing Sheets 10
12
14
16
20
22
22a
24
24a
26
28
30
32
32(34)
34
36
40
44
50
52
54
56
60
62
70
72
74
76
78
80
82
84
100
102
104
106
108
110
M
R
S

SHEET TRANSPORTING APPARATUS WITH A TRANSPORT BELT TO WHICH SHEETS ARE SELECTIVELY CLAMPED

BACKGROUND OF THE INVENTION

The present invention relates in general to apparatus for transporting sheets, and more particularly, to a sheet transporting apparatus having a transport belt to which sheets are selectively positively clamped.

In typical reproduction apparatus in commercial use such as copiers, printers, or the like, reliable handling of sheets is essential. Illustratively, in copiers, original information is copied by capturing an image of such information and using such image to produce a copy of such information. The original information may be contained on a document sheet which is placed on a platen for exposure to a light source to form a light image of the information contained thereon, and copies of such information are produced on receiver sheets such as plain bond paper. The document sheets must be carefully handled to prevent damage thereto, and must be reliably positioned for accurate information image acquisition. Further, reliable accurate positioning of the receiver sheets is required to assure that the resultant copies are suitable for their intended use.

In order to more fully utilize the high speed copying capabilities of modern commercial copier apparatus, it is desirable to automatically handle the movement of document sheets to the exposure platen. However, such document sheets can vary widely in size, weight, thickness, and condition. Therefore, it has been difficult to design a document feeder which reliably functions to accurately place the document sheets of all types on the platen without damage to the document sheets. Similarly, receiver sheets may also vary in size, weight, and thickness. Accordingly, feeders for the receiver sheets have also presented design challenges.

With regard to the document transporting device, such device must move the document sheet rapidly to the exposure platen, and must accurately register the document sheet on the platen in a predetermined location to assure production of a complete and acceptable copy. For example, if the document sheet (or the receiver sheet) is skewed or misaligned relative to the predetermined location, the copy will reflect the same skew or misalignment, and may be incomplete or unacceptable in perceived quality by the user. Further, the document transporting device must not damage the original document sheets. If the original document sheet is torn or creased, it may not be of further use to the user, and certainly would not be suitable for subsequent handling by the transporting device.

In transporting either document or receiver sheets, it is common practice to use belts and/or rollers to physically engage the sheets to effect transport thereof. Such physical engagement of the sheets may result in skewing of the transported sheets, and thus improper registration, with the resulting images being created or formed in a manner in which the reproductions are not suitable for their intended use. Other mechanisms for transporting sheets involve clamping the sheets by vacuum to a moving belt, or by a physical clamping mechanism to a chain or drum, and moving the sheet therewith. Such devices provide for a more accurate location of the sheets at various locations over their travel. However, due to the complexity in effecting the clamping action, these devices are complicated in construction and expensive to manufacture.

SUMMARY OF THE INVENTION

In view of the foregoing discussion, this invention is directed to a sheet transporting apparatus for transporting document sheets, wherein passive gripper gates, of simplified construction, selectively attach a sheet to the transport belt of the sheet transporting apparatus. The sheet transporting apparatus comprises a transport belt having a passive mechanism for selectively clamping a document sheet thereto. The passive clamping mechanism includes at least one gripper gate having a support plate, means for attaching the support plate to the transport belt, a spring arm connected to the support plate extending over the support plate on the opposite side thereof from the transport belt, and a grip surface connected to the spring arm extending over at least a portion of the support plate on the opposite side of the transport belt from the support plate. The spring arm urges the grip surface into engagement with the transport belt. The transport belt is moved along a path, and a sheet is delivered into association with the passive clamping mechanism. The passive clamping mechanism is selectively actuated to clamp a sheet delivered into association therewith to the transport belt for movement with the transport belt. A mechanism for actuating the passive clamping mechanism includes a roller-like member and moving means connected to the roller-like member for moving the roller-like member into contact with the spring arm on selective actuation thereof and moving the roller-like member out of contact with the spring arm on selective de-actuation thereof. The roller-like member is located adjacent to the travel path of the transport belt such that on movement of the transport belt, the roller-like member will contact the spring arm to move the spring arm in a direction opposite to that of the spring arm urging force n the grip surface to position the grip surface away from the transport belt a distance sufficient to enable a sheet to be readily accommodated between the grip surface and the transport belt. A mechanism, located downstream in direction of movement of the transport belt, selectively deactuates the passive clamping mechanism to release a sheet from the clamping mechanism of the transport belt. Thereafter, the sheet is separated from the transport belt.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figures 1, 2A, 2B, 2C:
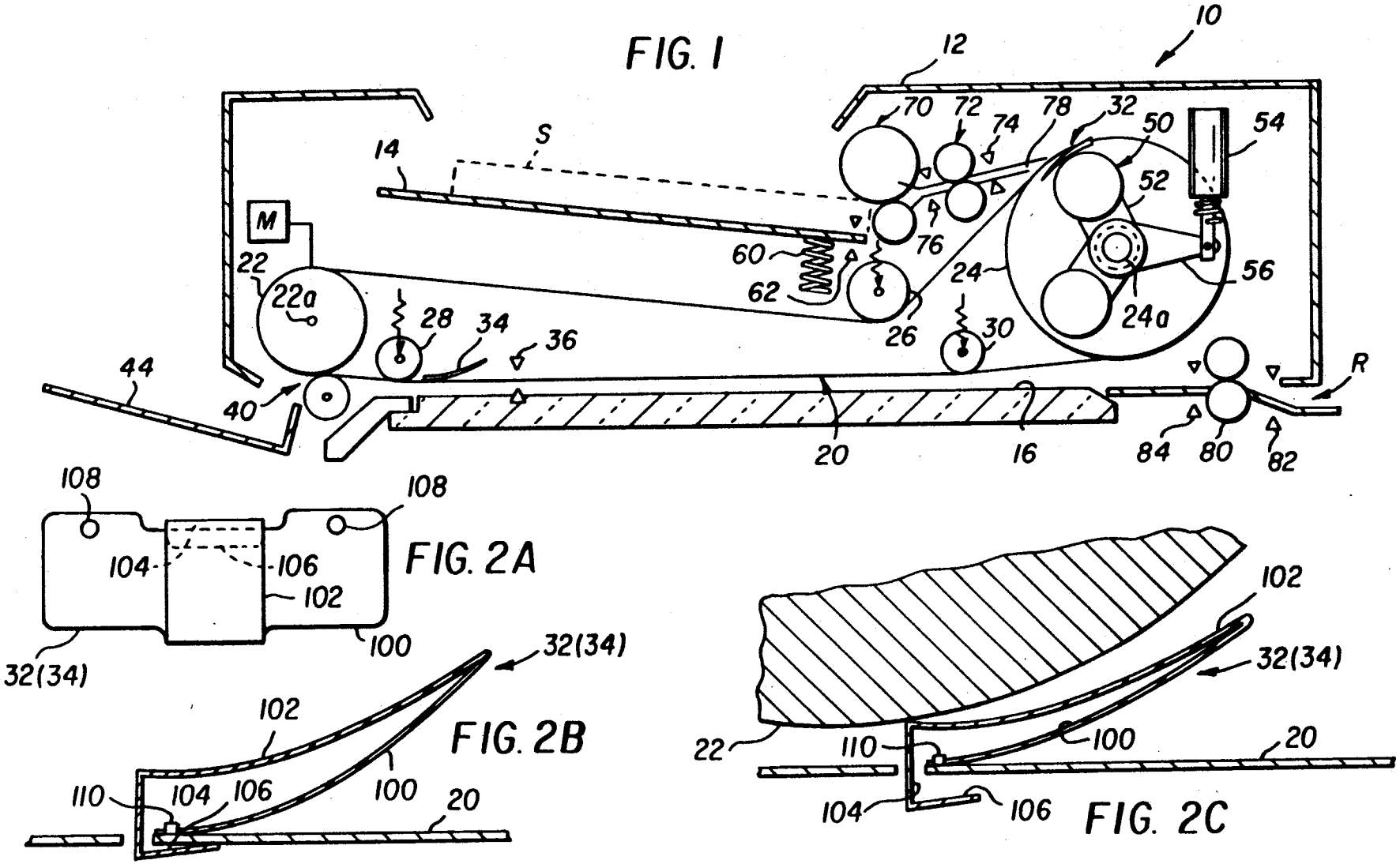
FIG. 1 is a front elevational view of the sheet transporting apparatus according to this invention, partly in cross-section and with portions removed to facilitate viewing.
FIG. 2*a* is a top plan view, on an enlarged scale, of a passive sheet clamping mechanism for the transport belt of the sheet transporting apparatus shown in FIG. 1.
FIGS. 2*b*, and 2*c* are front elevational views, on an enlarged scale, of a portion of the transport belt of the sheet transporting apparatus of FIG. 1 and the passive sheet clamping mechanism of FIG. 2*a*, such passive clamping mechanism being shown respectively in its closed position and its open position.

Referring now to the accompanying drawings, FIG. 1 shows a sheet transporting apparatus, designated generally by the numeral 10, according to this invention. While the sheet transporting apparatus 10 is shown and described as a document sheet feeder, for use with a reproduction apparatus, for transporting seriatim document sheets, containing information to be reproduced, from a stack of document sheets to the information capture station of the reproduction apparatus, it is understood that this invention is suitable for use in any other application where it is desired to accurately and reliably feed sheets individually to a desired location.

The sheet transporting apparatus 10 includes a housing 12 containing a tray 14 for supporting a stack of sheets, such as, for example, a stack S of document sheets (indicated in phantom in FIG. 1). The document sheets in the stack S contain original information to be reproduced by any well known reproduction apparatus R (only a portion of which is shown in FIG. 1) where the information is captured at an information capturing station 16. In the illustrated embodiment, station 16 is a transparent platen where a document sheet overlying the platen is exposed by a light source to form a reflected light image of the information contained on the document sheet. Of course, the information capturing station 16 could also be an exposure slit where information contained on the document sheet is captured optically or electronically for subsequent reproduction.

A belt transport and gripper gate arrangement for the sheet transporting apparatus 10 selectively transports sheets from the area of the stack S on the tray 14 to the information capturing station 16, and then to a sheet collection tray 44. The transport belt 20 is mounted for movement about a closed loop path defined by the rollers 22–30 supported in the apparatus housing 12. The rollers 22 and 24 describe the major portion of the path and respectively rotate about fixed axes, with the roller 22, for example, being the drive roller. Roller 26 is a tension roller, and along with rollers 28 and 30, overlying the platen of the information capturing station 16, are spring loaded. The roller 22 is driven by a motor M coupled to the support shaft 22*a* thereof. The motor M is, for example, of the stepper motor type, more fully discussed below.

The transport belt 20 is made, for example, of a polyester material and is white in color. It is of a dimension, measured transverse to the direction of travel of the transport belt about the closed loop path, so as to completely cover the platen of the information capturing station 16. In this manner, image capture at the station 16 does not produce copy artifacts which could adversely effect quality of the reproduction of the information from the document sheet.

Individual gripper gates 32, 34 are attached to the transport belt 20. The gripper gates are arranged in pairs (i.e., two gates 32 and two gates 34) respectively spaced in the direction transverse to the direction of travel of the transport belt about the closed loop path. Each pair of gripper gates establishes a respective reference position for the lead edge of a sheet to be transported by the belt 20 about the closed loop path. The gripper gate pairs are located so as to divide the belt perimeter, in the direction of travel about the closed loop path, substantially exactly in half.

The construction of the individual gripper gates 32, 34, is best shown in FIGS. 2*a*, 2*b* and 2*c*. Each of the gripper gates (one gate shown, with the others being of identical construction) is formed of a spring-like material, such as beryllium copper for example, folded back on itself in the manner shown. As such, a gripper gate has a support plate 100, a spring arm 102, a registration surface 104, and a grip surface 106. The spring arm 102 exerts a small but significant preload force (e.g., two ounces of force) urging the grip surface 106, attached to the spring arm 102 through the registration surface 104, toward the support plate 102.

The gripper gates 32, 34 are attached, at the holes 108 defined in the supporting plate 100, to the transport belt 20 by suitable mounting mechanisms 110 such as pins, rivets, or integral folded tabs for example. The holes 108, and thus the mounting mechanisms 110, are in a line substantially even with the registration surface 104 to locate the respective gripper gates so as to be tangent to the belt 20 adjacent to the grip surface 106. The support plate 100 and spring arm 102 are curved to a degree such that the gripper gates can travel smoothly with the belt 20 around the smallest diameter roller defining the belt travel path without causing undue localized stresses in the belt.

FIGS. 2*b* and 2*c* show a gripper gate 32 (34) respectively in its closed and open state. The gripper gate is a passive device and, in view of the preload force of the spring arm 102, remains in its closed state (see FIG. 2*b*) in the absence of any obstructional element in the belt travel path along the inner side of the belt 20. To open the gripper gate, an obstructional element must be introduced into the belt travel path along the inner side of the belt. The obstructional element is, for example, a roller such as the support roller 22 or an internal roller cam set 50 (to be more fully discussed below). The obstructional element acts on the spring arm 102 as it moves relative to the belt 20 into contact with that portion of the inner side of the belt to which the gripper gates are attached (see FIG. 2*c*) to move the grip surface 106 away from the spring arm. In such open position, the gripper gate is ready to have the lead edge of a sheet enter the gate for engagement with the registration surface 104, or exit from the gate.

To grip a sheet, the belt 20 and obstructional element are moved relatively such that the spring arm 102 is out of contact with the obstructional element and returns the grip surface 106 toward support plate 100 into gripping engagement with the lead edge of the sheet held between the belt 20 and the grip surface 106. While the grip surface 106 extends from the registration surface 104 a distance so as to grip a lead edge of a sheet engaging the registration surface, such distance is selected to lie within the marginal edge of the sheet which does not contain any information to be reproduced.

Figure 3:
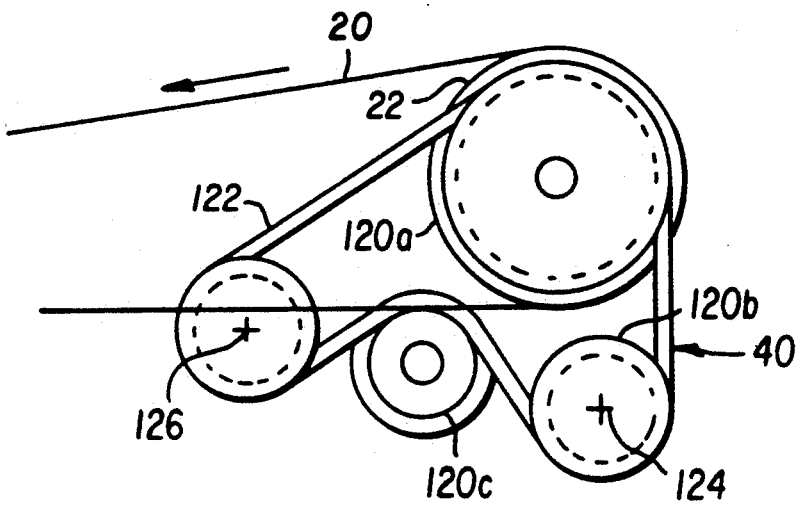
FIG. 3 is a rear elevational view, on an enlarged scale, of a portion of the transport belt and the exit mechanism for assuring removal of a sheet from the passive clamping mechanism on release of the clamping mechanism.
Figure 4:
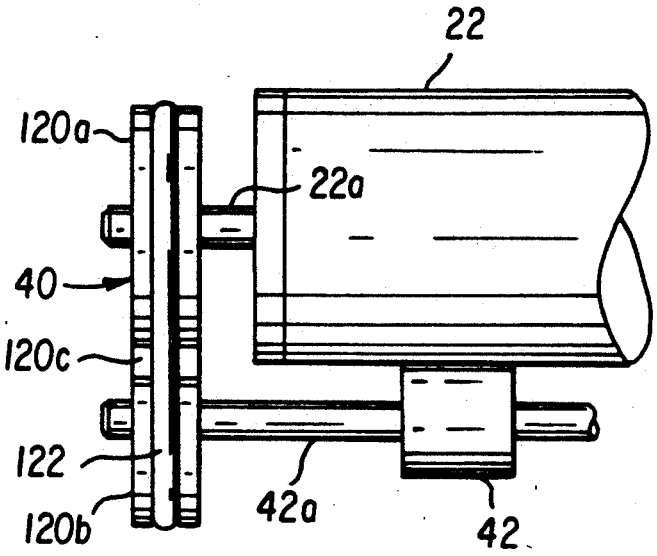
FIG. 4 is an end elevational view, on an enlarged scale, of a portion of the transport belt and the exit separation mechanism of FIG. 3.

As will be appreciated, merely opening the gripper gates (for example, by movement of the belt 20 about the support roller 22) does not guarantee that the sheet will be released from the gates. Accordingly, at the downstream location from the platen 14, to release the document sheet from the grasp of the gripper gates for delivery to the collection tray 44, an exit separation mechanism 40 is provided to aid in the removal of a sheet from the gripper gates. A plurality of rollers 42, belonging to the exit separation mechanism 40, are mounted at spaced intervals along a shaft 42*a* located parallel to the shaft 22*a* of the roller 22 (see FIGS. 3 and 4), in nip relation with the roller 22. An arrangement of pulleys 120*a*–120*d* are interconnected by a drive belt such as an O-ring 122. Respectively, the pulley 120*a* is mounted on the shaft 22*a* of the drive roller 22, pulley 120*c* is mounted on the shaft 42*a* of the rollers 42, and pulleys 120*b* and 120*d* are mounted on independent individual support shafts 124 and 126.

The diameters and spacing of the pulleys 120*a*–120*d* of the exit separation mechanism 40 are selected to yield a path length for the drive belt O-ring 122 such that when the rollers 42 are rotated by the exit separation mechanism, the peripheral speed of such rollers is substantially less than the peripheral speed of the belt 20 as it passes around the drive roller 22. Under normal conditions however, when the rollers 42 contact the belt 20, the belt 20 drives the rollers, at a like peripheral speed. That is, the frictional engagement between the rollers 42 and the belt 20 overcomes the drive force of the O-ring 122 on the interconnected pulley arrangement such that the O-ring stretches and slips on the pulley 120*c* as the shaft 42*a* turns at a higher speed. When a sheet enters the nip between the rollers 42 and the belt 20, the direct drive of the rollers 42 by the belt 20 is interrupted. At this time the O-ring 122 becomes effective to drive the pulley 120*c*, and thus the roller shaft 42*a* and the associated rollers 42 at the slower speed. As such, the slower rotating rollers 42 act on the sheet in the gripper gate to effectively slow the sheet and pull the sheet lead edge from the gripper gate where it is delivered to the collection tray 44.

Figure 5A:
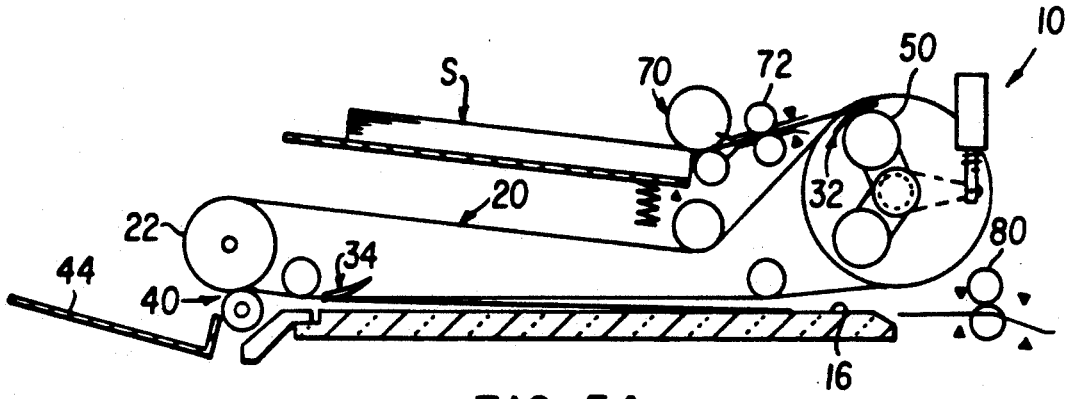
FIGS. 5*a*–5*h* are front elevational views of the sheet transporting apparatus of FIG. 1, respectively, depicting the operation of the sheet transporting apparatus at sequential intervals.

With the basic construction of the sheet transporting apparatus 10 described above, its general modes of operation are as follows. In the mode of operation for transporting document sheets from a document sheet stack, the document sheet stack S is placed on the tray 12. A spring 60 urges the tray 12 toward a position where the lead edge of the stack in engagement with a feed and separation mechanism 70, such as a scuff roller, for example. A sensor 62, located in association with the tray 12, indicates the presence of the sheet stack S on the tray. The motor M is activated to drive the roller 22 in a clockwise direction (in FIG. 1) and transport the belt 20 about its closed loop path. A registration sensor 36 is used to detect the proximity of a pair of gripper gates (32 or 34) approaching the platen exposure registration point. Once the gripper gate pair is detected by the sensor 36, the motor M will continue to operate through a predetermined number of steps sufficient to bring the gripper gate pair to a location where it is in registration with the information capturing station 16 of the reproduction apparatus, and the will stop. The gripper gate pair is thus properly located relative to the station and the other pair of gripper gates, located half way around the belt 20, is properly located relative the feed and separation mechanism 70 (see FIG. 5*a*). The gripper gate pair (34 or 32) positioned at the sheet feed entrance to the path of the belt 20 is opened by the internal roller cam set 50. The roller cam set 50 is attached to pivot arms 52 which are mounted on the support shaft 24*a* for the roller 24. The shaft 24*a* is rotated through an angle by a selectively actuated solenoid 54, connected to the shaft by an arm 56, sufficient to cause one of the rollers of the roller cam set 50 to contact the spring arms 102 of the gripper gates at the sheet feed entrance to open such gripper gates. The mechanism 70 is then activated to remove the topmost document sheet from the stack S, and deliver such sheet through an outfeed roller nip 72, where it is advanced to the buckle area 78, and into the open gripper gates.

Figure 5B:
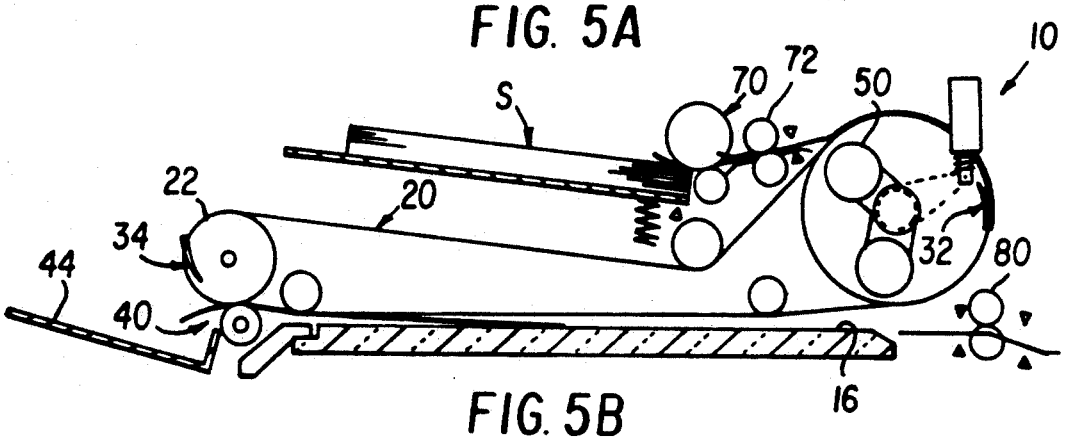

Thereafter, the solenoid 54 is deactuated so that the roller of the roller cam set 50 which caused the associated gripper gates to open is returned to its position out of contact with such gripper gates. Of course, due to the passive nature of the gripper gates, such gates will close about the lead edge of the document sheet inserted therein to grip such lead edge. The document sheet is thus clamped to the belt 20 for travel with the belt as it is transported about its closed loop travel path (see FIG. 5*b*).

It should be noted that a recent method provided for improving the productivity of reproduction apparatus involves the use of sheets which include indicia, read by the reproduction apparatus, which controls various functions of the reproduction apparatus. Such sheets, referred to as key sheets, are not in-and-of themselves reproduced, but provide instructions for the reproduction apparatus, such as, for example, whether to reproduce copies as duplex copies or whether to use alternate development mechanisms (of different colors). Therefore, when a document sheet is delivered through the outfeed roller nip 72, such sheet may be stopped with its lead edge at a position determined by a sensor 74. At this position a sensor 76 checks to see if the sheet is a key sheet, which must be read to determine the reproduction apparatus instructions (and is not to be reproduced), or is a document sheet which is to be reproduced.

Figure 5C:
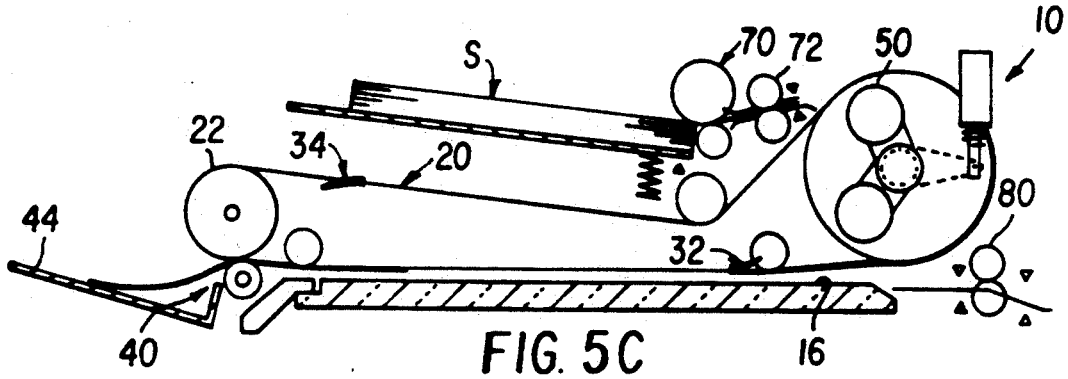
Figure 5D:
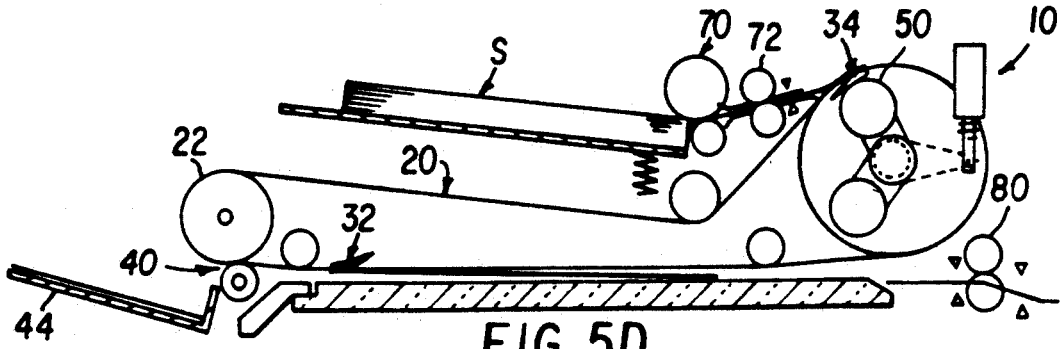

After a document sheet is clamped to the belt 20, the motor M is again actuated to transport the belt about its closed loop path. Once again, the sensor 36 is employed to detect the proximity of a pair of gripper gates (this time clamping the document sheet to the belt 20) approaching the platen exposure registration point. As described above, on detection of the gripper gate pair, the motor M will continue to operate through a predetermined number of steps sufficient to bring the gripper gate pair to a location where it is in registration with the information capturing station 16 of the reproduction apparatus, and then will stop. The gripper gate pair, and thus the document sheet to be reproduced, is properly located relative to the station and the other pair of gripper gates is properly located relative the feed and separation mechanism 70 (see FIG. 5*c*). The gripper gate pair positioned at the sheet feed entrance to the path of the belt 20 is opened by the internal roller cam set 50, as described, to receive the next document sheet from the stack S while the document sheet in register with the image capture station 16 has an image of the information contained thereon captured for reproduction. Once the image has been captured and the next document sheet is clamped to the belt 20, the motor M reactivated to transport the belt 20 about its closed loop path. That portion of the belt bearing the gripper gates clamping the first document sheet to the belt passes around the roller 22 where the gripper gates are opened as described above. The exit separation mechanism 40 removes the document sheet from the gripper gate and delivers the document sheet to the collection tray 44 (see FIG. 5*d*). This cycle is then repeated until all the document sheets have been reproduced.

Figure 5E:
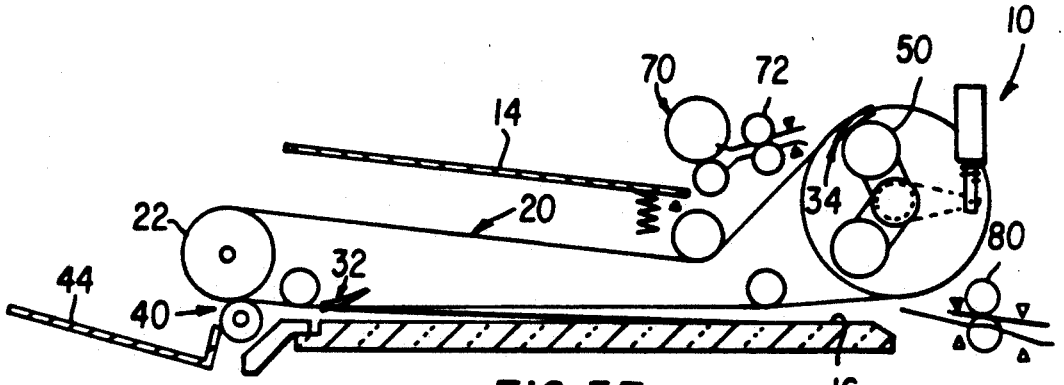
Figure 5F:
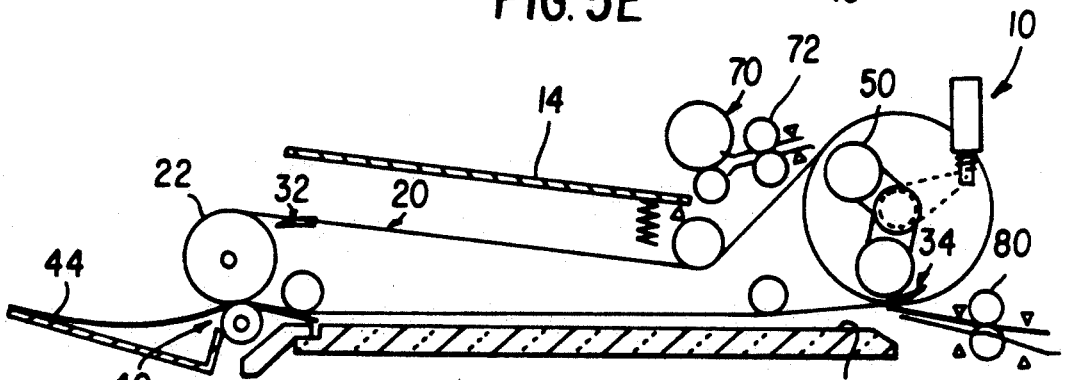

For operation of the sheet transporting apparatus 10 in the positioner mode, as a single document sheet is manually inserted into the infeed nip rollers 80, it is detected by a document sheet present sensor 82. The nip rollers 80 are activated to advance the document sheet until the lead edge thereof is detected by a lower feed sensor 84. The document sheet is stopped at the lower feed sensor and awaits the arrival of the gripper gates (see FIG. 5*e*). The motor M is actuated to transport the belt, and the gripper gate pairs, about the closed loop path until a pair of the gripper gates are at a position adjacent to the area of the document sheet stopped at the lower feed sensor 84 where the motor is de actuated and the belt is stopped. The solenoid 54 of the roller cam set 50 is then actuated to move the roller cam set to a position to open the gripper gate pair, and the nip rollers 80 are actuated to feed the document sheet into the gripper gates. Deactuation of the solenoid 54 serves to effect clamping of the document sheet to the belt 20 by the gripper gates as described above (see FIG. 5*f*).

Figure 5G:
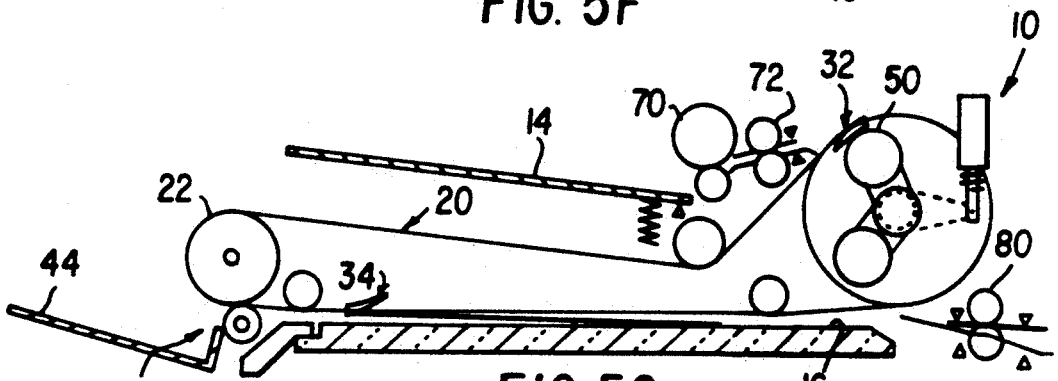
Figure 5H:
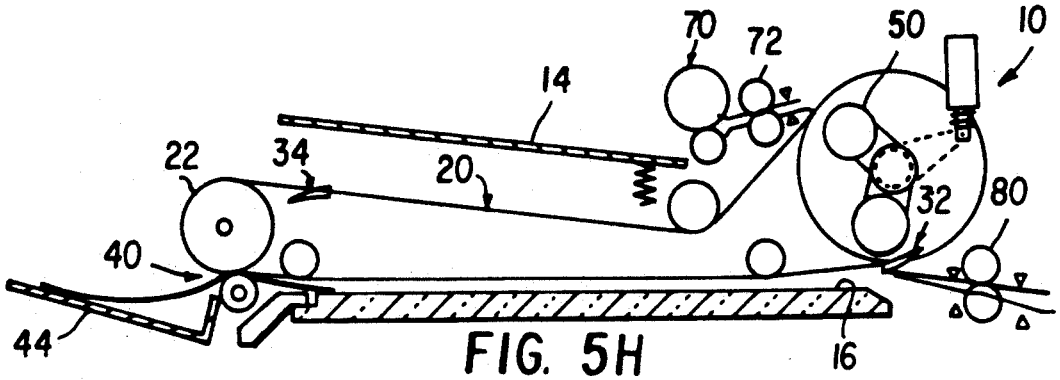

At this point in time, the motor M is again actuated to transport the belt about its closed loop path. As above, the sensor 36 is employed to detect the proximity of the pair of gripper gates clamping the document sheet to the belt 20 as it approaches the platen exposure registration point. On detection of the gripper gate pair, the motor M will continue to operate through a predetermined number of steps sufficient to bring the gripper gate pair to a location where it is in registration with the information capturing station 16 of the reproduction apparatus, and then will stop. The gripper gate pair, and thus the document sheet to be reproduced, is properly located relative to the station 16 (see FIG. 5*g*). Once the image has been captured, the motor M reactivated to transport the belt 20 about its closed loop path. As described above, that portion of the belt bearing the gripper gates clamping the document sheet to the belt passes around the roller 22 where the gripper gates are opened, and the exit separation mechanism 40 removes the document sheet from the gripper gate for delivery to the document sheet to the collection tray 44 (see FIG. 5*h*).

The sheet transporting apparatus 10, according to this invention, can also be operated in a fully manual mode for copying information contained on books or other material which is placed by hand directly on the platen of the image capture station 16. In this mode of operation, when the housing 12 of the sheet transporting apparatus 10 moved away form the platen, such as by pivoting about an axis (not shown) to the rear of the apparatus, a registration edge 90 raises automatically from a recess 92 adjacent to the platen. The registration edge 90 provides a guide for placing material on the platen in registration for proper reproduction. When the apparatus 10 is returned to its operative location relative to the platen 14, the registration edge 90 is automatically urged back into the recess 92 out of the sheet feed path.

The invention has been described in detail with particular reference to preferred embodiments thereof, but it will be understood that variations and modifications can be effected within the spirit and scope of the invention as set forth in the claims.

What is claimed is:

1. A sheet transporting apparatus comprising:

a transport belt having a passive clamp means for selectively effecting clamping of a sheet thereto, said passive clamp means including at least one gripper gate, said gripper gate having a support plate, means for attaching said support plate to said transport belt, a spring arm connected to said support plate extending over said support plate on the opposite side thereof from said transport belt, and a grip surface connected to said spring arm extending over at least a portion of said support plate on the opposite side of said transport belt from said support plate, said spring arm urging said grip surface into engagement with said transport belt;

means for moving said transport belt along a path;

means for delivering a sheet into association with said passive clamp means;

means for selectively actuating said passive clamp means to clamp a sheet delivered into association therewith to said transport belt for movement with said transport belt, said actuating means for said passive clamp means including a roller-like member and moving means connected to said roller-like member for moving said roller-like member into contact with said spring arm on selective actuation thereof and moving said roller-like member out of contact with said spring arm on selective de-actuation thereof, said roller-like member located adjacent to the travel path of said transport belt such that on movement of said transport belt, said roller-like member will contact said spring arm to move said spring arm in a direction opposite to that of said spring arm urging force on said grip surface to position said grip surface away from said transport belt a distance sufficient to enable a sheet to be readily accommodated between said grip surface and said transport belt;

means, located downstream in direction of movement of said transport belt, for selectively deactuating said passive clamp means to release a sheet from said passive clamp means; and means for separating said sheet from said transport belt.

2. The sheet transporting apparatus of claim 1 wherein said passive clamp means includes a pair of gripper gates located in spaced relation along a line transverse to the direction of travel of said transport belt.

3. The sheet transporting apparatus of claim 2 wherein said passive clamp means includes a plurality of pairs of gripper gates, said pair of gripper gates respectively attached to said transport belt at spaced intervals in the direction of travel of said transport belt about its closed loop path.

4. The sheet transporting apparatus of claim 1 wherein said means for attaching said support plate to said transport belt includes at least one pin located so as to position said gripper gate tangent to said transport belt adjacent to said grip surface.

5. The sheet transporting apparatus of claim 1 said means for deactuating said passive clamp means includes a roller supporting said transport belt and defining a portion of said path for said transport belt, said roller moving into contact with said spring arm only as that portion of said transport belt to which said gripper gate is attached moves about said roller.

6. A sheet transporting apparatus comprising:

a transport belt having passive clamp means for selectively effecting clamping of a sheet thereto;

means for moving said transport belt along a path, said transport belt moving means includes a plurality of rollers supporting said transport belt and defining said path for said transport belt, one of said plurality of rollers being in driving association with said transport belt, and a stepper motor coupled to said one of said plurality of rollers for selectively rotating such roller in stepped increments to accurately control movement of said transport belt along its path, and means, located in association with said transport belt travel path, for detecting said passive clamp means, and means, responsive to said detecting means on detection of said passive clamp means, for respectively activating said passive clamp means actuation means, said sheet delivery means, and said passive clamp means deactuation means;

means for delivering such sheet into association with said passive clamp means;

means for selectively actuating said passive clamp means to clamp a sheet delivered into association therewith to said transport belt for movement with said transport belt;

means, located downstream in direction of movement of said transport belt, for selectively deactuating said passive clamp means to release a sheet from said passive clamp means; and means for separating said sheet from said transport belt.

7. A sheet transporting apparatus comprising:

a transport belt having passive clamp means for selectively effecting clamping of a sheet thereto;

means for moving said transport belt along a path, said transport belt moving means includes a plurality of rollers supporting said transport belt and defining said path for said transport belt, one of said plurality of rollers being in driving association with said transport belt, and a stepper motor coupled to said one of said plurality of rollers for selectively rotating such roller in stepped increments to accurately control movement of said transport belt along its path, and means, located in association with said transport belt travel path, for detecting said passive clamp means, and means, responsive to said detecting means on detection of said passive clamp means, for respectively activating said passive clamp means actuation means, said sheet delivery means, and said passive clamp means deactuation means;

means for delivering such sheet into association with said passive clamp means;

means for selectively actuating said passive clamp means to clamp a sheet delivered into association therewith to said transport belt for movement with said transport belt;

means, located downstream in direction of movement of said transport belt, for selectively deactuating said passive clamp means to release a sheet from said passive clamp means; and means for separating said sheet from said transport belt, said sheet separating means including retard means for engaging a sheet transported with said transport belt by said passive clamp means and slowing the movement of such sheet to positively remove such sheet from said passive clamp means, said retard means includes at least one retard roller in friction engagement with said transport belt, and a slip drive means coupled to said retard roller for driving said retard roller at an angularly velocity such that the peripheral speed of the retard roller is less than the peripheral speed of said transport belt on movement along its path, wherein when said retard roller is in engagement with said transport belt, said retard roller is driven by said moving transport belt at a peripheral speed substantially equal to the peripheral speed thereof overcoming the effect of said slip drive means on said retard roller, and when a sheet transported by said transport belt is located between said retard roller and said transport belt, said slip drive means is effective to slow the peripheral speed of said retard roller and thus slow movement of such sheet.

8. The sheet transporting apparatus of claim 7 wherein said slip drive means includes an arrangement of pulleys interconnected by an O-ring.

9. For use with a reproduction apparatus for reproducing original information contained on document sheets, said reproduction apparatus including a station where information contained on document sheets is captured for reproduction, a sheet transporting apparatus for transporting document sheets into association with said information capture station of said reproduction apparatus, said sheet transporting apparatus comprising:

a tray for supporting a stack of document sheets;

a transport belt having passive means for selectively clamping a document sheet thereto;

means for moving said transport belt about a closed loop path, a first portion of said path located adjacent to said tray and a second portion of said path located in juxtaposition with said information capturing station of said reproduction apparatus;

means for selectively removing a document sheet from a stack of document sheets supported on said tray and delivering such document sheet into association with said passive clamping means of said transport belt;

means for selectively actuating said passive clamping means to clamp a document sheet delivered into association therewith to said transport belt for movement with said transport belt;

means for sensing the location of a document sheet clamped to said transport belt as said sheet moves into association with said information capturing station of said reproduction apparatus;

means responsive to said sensing means for stopping movement of said transport belt at a predetermined time, and for a predetermined interval, to accurately locate said clamped document sheet relative to said information capturing station to enable information contained on said document sheet to be captured;

means, located downstream of said information capture station in direction of movement of said transport belt, for selectively deactuating said passive clamping means to release a document sheet from said passive clamping means of said transport belt; and means for separating said document sheet from said transport belt.

10. The sheet transporting apparatus of claim 9 wherein said passive clamping means for selectively clamping a document sheet to said belt includes at least one gripper gate, said gripper gate having a support plate, means for attaching said support plate to said transport belt, a spring arm connected to said support plate extending over said support plate on the opposite side thereof from said transport belt, and a grip surface connected to said spring arm extending over at least a portion of said support plate on the opposite side of said transport belt from said support plate, said spring arm urging said grip surface into engagement with said transport belt.

11. The sheet transporting apparatus of claim 10 wherein said passive clamping means includes a pair of gripper gates located in spaced relation along a line transverse to the direction of travel of said transport belt about its closed loop path.

12. The sheet transporting apparatus of claim 11 wherein said passive clamping means includes a plurality of pairs of gripper gates, said pairs of gripper gates respectively attached to said transport belt at spaced intervals in the direction of travel of said transport belt about its closed loop path.

13. The sheet transporting apparatus of claim 10 wherein said support plate of said gripper gate is attached to said transport belt at the surface interior to the closed loop path of said transport belt.

14. The sheet transporting apparatus of claim 13 wherein said means for attaching said support plate to said transport belt includes at least one pin located so as to position said gripper gate tangent to said transport belt adjacent to said grip surface.

15. The sheet transporting apparatus of claim 10 wherein said actuating means for said passive clamping means includes obstruction means located adjacent to and within the closed loop path of said transport belt such that on movement of said transport belt, said obstruction means carried therewith will contact said spring arm and said spring arm when contacted by said obstruction means, is moved in a direction opposite to that of said arm urging force on said grip surface to position said grip surface away from said transport belt a distance sufficient to enable a document sheet to be readily accommodated between said grip surface and said transport belt.

16. The sheet transporting apparatus of claim 15 wherein said obstruction means includes a roller-like member and moving means connected to said roller-like member for moving said roller-like member into contact with said spring arm on selective actuation thereof and moving said roller-like member out of contact with said spring arm on selective de-actuation thereof.

17. The sheet transporting apparatus of claim 15 wherein said obstruction means includes a roller-like member and moving means connected to said roller-like member for moving said roller-like member into contact with said spring arm on selective actuation thereof and moving said roller-like member out of contact with said spring arm on selective de-actuation thereof, and wherein said clamping means deactuating means includes a roller supporting said transport belt and defining a portion of said closed loop path for said transport belt, said roller moving into contact with said spring arm only as that portion of said transport belt to which said gripper gate is attached moves about said roller.

18. The sheet transporting apparatus of claim 10 wherein said deactuating means for said passive clamping means includes a roller supporting said transport belt and defining a portion of said closed loop path for said transport belt, said roller moving into contact with said spring arm only as that portion of said transport belt to which said gripper gate is attached moves about said roller.

19. The sheet transporting apparatus of claim 9 wherein said transport belt moving means includes a plurality of rollers supporting said transport belt and defining said closed loop path for said transport belt, one of said plurality of rollers being in driving association with said transport belt, and a stepper motor coupled to said one of said plurality of rollers for selectively rotating such roller in stepped increments to accurately control movement of said transport belt about its closed loop path.

20. The sheet transporting apparatus of claim 19 wherein said transport path moving means further includes means, located in association with said transport belt travel path, for detecting said passive clamping means, and means, responsive to said detecting means on detection of said passive clamping means, for respectively activating said passive clamping means actuation means, said document sheet delivery means, and said passive clamping means deactuation means.

21. The sheet transporting apparatus of claim 9 wherein said sheet separating means includes retard means for engaging a document sheet transported with said transport belt and slowing the movement of such document sheet to positively remove such document sheet from said passive clamping means.

22. The sheet transporting apparatus of claim 21 wherein said retard means includes at least one retard roller in friction engagement with said transport belt, and a slip drive means coupled to said retard roller for driving said retard roller at an angular velocity such that the peripheral speed of the retard roller is less than the peripheral speed of said transport belt in movement about its closed loop path, wherein when said retard roller is in engagement with said transport belt, said retard roller is driven by said moving transport belt at a peripheral speed substantially equal to the peripheral speed thereof overcoming the effect of said slip drive means on said retard roller, and when a sheet transported by said transport belt is located between said retard roller and said transport belt, said slip drive means is effective to slow the peripheral speed of said retard roller and thus slow movement of such document sheet.

23. The sheet transporting apparatus of claim 22 wherein said slip drive means includes an arrangement of pulleys interconnected by an O-ring.

* * * * *